US005407183A

United States Patent [19]

Singeltary

[11] Patent Number: 5,407,183

[45] Date of Patent: Apr. 18, 1995

[54] DRYWALL INSTALLATION TOOL

[76] Inventor: James C. Singeltary, Rte. 1, Box 142 A, Lovettsville, Va. 22080

[21] Appl. No.: 203,354

[22] Filed: Mar. 1, 1994

[51] Int. Cl.[6] ..... B23Q 3/02

[52] U.S. Cl. ..... 269/43; 269/101; 269/102; 269/904; 248/300; 248/544

[58] Field of Search ..... 269/102, 101, 904, 37, 269/43; 248/300, 544; 24/464; 52/DIG. 1; 33/645, 646, 647, 648, 649

[56] References Cited

U.S. PATENT DOCUMENTS

| | | | |
|---|---|---|---|
| 2,345,419 | 3/1944 | Olson | 269/102 |
| 2,575,595 | 11/1951 | Rienecker | 269/102 |
| 3,452,963 | 7/1969 | Holst | 254/131 |
| 3,904,184 | 9/1975 | Krueger | 269/102 |
| 4,564,182 | 1/1986 | Svajgl | 269/404 |
| 5,170,976 | 12/1992 | Lundman | 248/300 |
| 5,195,710 | 3/1993 | Remblier | 248/300 |

*Primary Examiner*—Robert C. Watson
*Attorney, Agent, or Firm*—Donald E. Townsend

[57] ABSTRACT

There is provided a drywall installation tool which is generally rectangular and has a first and second section. In one embodiment, the first section being provided with at least two apertures through which nails or screws can be placed to secure the tool to a drywall sheet that is already in place. A spacer is provided on the surface of the first section of the tool to properly position the tool on the installed drywall surface. When the tool is positioned on a installed drywall surface, the next sheet of drywall is then placed on the second section of the tool and pushed upwardly to properly position the second sheet of drywall on studs or metal supports and the drywall tool holds the sheet of drywall in place while it is being secured with either nails or screws to the underlying support structure. The first and second sections of the drywall installation tool are angled one from the other at an angle of from about 15 to 30 degrees and a frictional surface is provided on the second section of the drywall tool to prevent the drywall from sliding downwardly while it is being positioned on an underlying support structure.

18 Claims, 1 Drawing Sheet

DRYWALL INSTALLATION TOOL

BACKGROUND OF THE INVENTION

The present invention relates in general to an installation tool and, more particularly, to a device or tool which can be used to install drywall.

PRIOR ART

In construction in the United States, it is conventional to apply drywall composed of sheets of gypsum covered with paper a surface sheet to form the interior walls of buildings and homes. These sheets can be various sizes and may be up to 4'×12'When drywall is applied to walls and ceilings, it is often necessary for one worker to hold the wallboard in place while another worker nails or screws the drywall to underlying boards or metal supports. In the case where a drywall board is applied in home construction as the ceiling, the wallboard must be accurately positioned and held up in place by one worker while it is secured to the wood rafters or metal supports by another worker. This is particularly true when large drywall section, such as 4'×12', weighing a considerable amount are secured to ceilings in this manner.

It is, therefore, an object of the present invention to avoid the necessity of having two workers secure drywall to ceiling areas.

It is also another object of the present invention to provide a tool which will assist workers in more accurately positioning drywall when applied to sidewalls.

SUMMARY OF THE INVENTION

A drywall installation tool is provided having first and second sections whose upper surfaces are at an angle of from about 15 to 30 degrees with respect to each other. The first section of the tool has at least two perforations through which a securing means, such as a nail or screw, can be inserted for securing the tool to a sheet of drywall which is already in place. A spacer projects from the upper surface of the first section of the tool to aid in accurately positioning the tool on the drywall surface, i.e. the spacer comes in contact with the edge of the drywall sheet which is already in place. The second section of the tool has at least a portion of its upper surface roughened to provide a frictional surface to prevent drywall from sliding down when it is brought into contact with the upper surface of the second section.

DETAILED DESCRIPTION OF THE INVENTION

Figure 1:
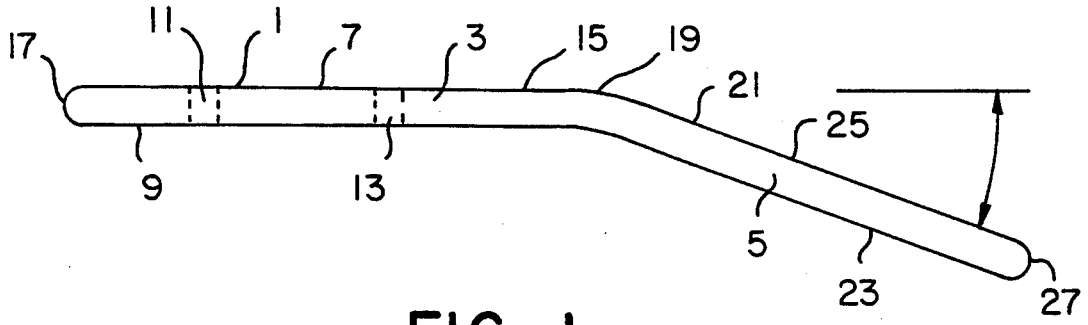
FIG. 1 is a side view of the drywall installation tool of the present invention, illustrating a preferred embodiment in which the perforations are spaced apart.
Figure 2:
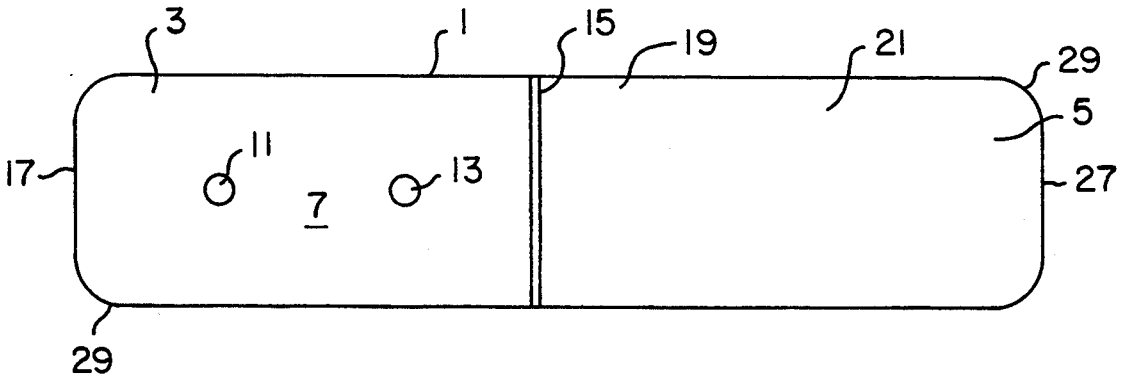
FIG. 2 is a top view of the drywall installation tool of FIG. 1, illustrating the rounded corners and positioning of the perforations.

The drywall installation tool of the present invention is shown generally at 1 in FIGS. 1 and 2. Tool 1 which is generally rectangular comprises a first planar section and a second section 5. The first section 3 has an upper surface 7 and a lower surface 9. The first section has at least two spaced apertures (holes) 11 and 13 through which a securing means, i.e. nail or screw, can be inserted to secure the tool to a sheet of drywall (not shown) which has already been secured in place.

A spacer means 15 projects upwardly from the upper surface 7 of the first planar section 3. The spacer means 15 preferably projects upwardly from the upper surface 7, a distance of from about 0.0625 to 0.1875 inches, and extends across the entire width of the first section 3. The spacer means 15 is preferably about 0.5 to 1.25 inches from the first side of the first section. The first section 3 has a first edge 17 which is opposite a first side 19 of the first section 3.

Tool 1 is integrally formed from a single sheet of metal or from a single piece of plastic, such as polycarbon. The first side 19 of the first sheet 3 is where the planar surface 7 of the first section 3 ends, i.e. where the upper surface of the tool begins to angle away from the planar surface 7 of the first section 3.

Generally, the first section 3 is adjacent the second section 5 and the second section has an upper surface 21 and a lower surface 23. The upper surface surface 21 of the second section 5 is generally planar and has a friction means 25 formed thereon (FIG. 1).

The friction means can take the form of a roughened surface or a sharp projection. In a preferred embodiment (not shown), the friction means 25 comprises a plurality of teeth projecting at an angle of less than 60 degrees from the upper surface 25, the teeth pointing toward the first side 15 of the first section 3.

The upper surface 25 of the second section 5 is at an angle of 15 to 30 degrees, preferably 20 to 25 degrees, most preferably at 20 degrees with respect to the upper surface 7 of the first section 3.

The first edge 17 of the first section 3 preferably is a smooth curved surface, thereby to avoid damage to a drywall surface when brought into contact therewith. Also, the outer edge 27 of the second section 5 is preferably provided with a smooth curved surface (FIG. 1 ) such as a circular surface.

The ends as well as the corners 29 of tool 1 are curved to avoid damage to drywall when brought into contact therewith. In a preferred embodiment, one of the two spaced holes 11 in first section 3 is about 0.5 to 1.25 inches from the first edge 17 of the first section.

What is claimed is:

1. A drywall installation tool comprising:

a first section having an upper and lower surface, the upper surface being planar and the first section having at least two spaced holes therein through which a securing means can be inserted to secure the tool to a sheet of drywall in place;

the first section having a spacer means projecting from the planar upper surface so as to abutt against an edge surface of sheet of drywall which is already in place when the tool is secured thereto;

the spacer means being spaced from a first side of the planar first section;

a second section being adjacent the first side of the first section, said second section having an upper and lower surface, with the upper surface being generally planar with at least a portion thereof having a friction means formed thereon;

the upper surface of the second section being positioned with respect to the upper surface of the first section at an angle of about 15 to 30 degrees.

2. The drywall installation tool of claim 1, wherein said tool is rectangular and one end of the tool in the first section has smooth curved edges and rounded corners, thereby to avoid damage to a drywall surface when said one end of the tool is brought into contact therewith.

3. The drywall installation tool of claim 1, wherein the first and second sections are integrally formed.

4. The drywall installation tool of claim 3, wherein the first and second sections are formed from a single metal sheet.

5. The drywall installation tool of claim 3, wherein the first and second sections are formed from a single piece of plastic.

6. The drywall installation tool of claim 1, wherein another end of the tool of the second section opposite said one end is provided with smooth curved edges and rounded corners.

7. The drywall installation tool of claim 1, wherein the friction means comprises a roughened surface on the upper surface of the second section.

8. The drywall installation tool of claim 1, wherein the friction means comprises a plurality of teeth formed on the upper surface of the second section.

9. The drywall installation tool of claim 8, wherein the teeth project from the upper surface of the second section at an angle of less than 60 degrees and the teeth point toward the first side of the first section.

10. The drywall installation tool of claim 1, wherein the upper surface of the second section is at an angle of from about 20 to 25 degrees to the upper surface of the first section.

11. The drywall installation tool of claim 1, wherein the upper surface of the second section is at an angle of about 20 degrees to the upper surface of the first section.

12. The drywall installation tool of claim 1, wherein the spacer means projects from the upper surface of the first section a distance of from about 0.0625 to 0.1875.

13. The drywall installation tool of claim 1, wherein the tool is generally rectangular and formed from a single metal sheet.

14. The drywall installation tool of claim 1, wherein the tool is generally rectangular and formed from a single piece of plastic.

15. The drywall installation tool of claim 1, wherein the spacer means is about 0.5 to 1.25 inches from the first side of the first section.

16. The drywall installation tool of claim 1, wherein there are two spaced holes through the first section, and one of the holes is about $\frac{3}{4}$ inches from the first edge of the first section.

17. A drywall installation tool comprising:

a first section having an upper and lower surface, the upper surface being planar and the first section having at least two spaced holes therein through which a securing means can be inserted to secure the tool to a sheet of drywall which is already in place;

the first section having a spacer means projecting from the planar upper surface so as to abut against an edge surface of a sheet of drywall already in place when the tool is secured thereto;

the spacer means being spaced from a first side of the first section;

a second section being adjacent to the first side of the first section, said second section having an upper and lower surface, with the upper surface being generally planar with at least a portion thereof having a fiction means thereon;

the upper surface of the second section being positioned with respect to the upper surface of the first section at an angle of from about 15 to 30 degrees;

wherein said tool is rectangular and one end of the tool in the first section has smooth curved edges and rounded corners, thereby to avoid damage to a drywall surface when the first side is brought into contact therewith; and wherein the first and second sections are integrally formed.

18. The drywall installation tool of claim 17, wherein another end of the tool in the second section has smooth curved edges and rounded corners;

the friction means comprises a plurality of teeth formed on the upper surface of the second section; and the upper surface of the second section is positioned with respect to the upper surface of the first section at an angle of from about 20 to 25 degrees.

* * * * *